US005833168A

United States Patent [19]

Tahata et al.

[11] Patent Number: 5,833,168

[45] Date of Patent: Nov. 10, 1998

[54] RESIDUAL PAPER WEB WINDING DEVICE

[75] Inventors: Masanori Tahata; Katsumi Aoki, both of Kanagawa, Japan

[73] Assignee: Kabushiki Kaisha Tokyo Kikai Seisakusho, Japan

[21] Appl. No.: 956,420

[22] Filed: Oct. 23, 1997

[30] Foreign Application Priority Data

Jan. 24, 1997 [JP] Japan ..... 9-011124

[51] Int. Cl.[6] ..... B65H 19/12

[52] U.S. Cl. ..... 242/559.2; 242/555.5

[58] Field of Search ..... 242/555.5, 559, 242/559.1, 559.2

[56] References Cited

U.S. PATENT DOCUMENTS

| | | | |
|---|---|---|---|
| 4,709,872 | 12/1987 | Hammer et al. | 242/559.2 |
| 4,903,910 | 2/1990 | Tamura | 242/559 |
| 4,948,060 | 8/1990 | Kurz et al. | 242/559.2 |
| 5,096,135 | 3/1992 | Eichenberger et al. | 242/559.1 |
| 5,192,033 | 3/1993 | Pipes | 242/559.1 |

FOREIGN PATENT DOCUMENTS

| | | |
|---|---|---|
| 1-106465 | 7/1989 | Japan . |
| 2-70645 | 3/1990 | Japan . |
| 4-223957 | 8/1992 | Japan . |
| 8-175725 | 7/1996 | Japan . |

*Primary Examiner*—John P. Darling
*Attorney, Agent, or Firm*—Rader, Fishman & Grauer; Ronald P. Kananen

[57] ABSTRACT

A reel feeding apparatus comprises a rotational shaft to be rotatably driven, plural pairs of reel supporting arms radially provided in an equally divided arrangement around the rotational shaft, each of the pairs of the supporting arms being arranged opposite to each other in an axial direction of the rotational shaft and movable in accordance with the rotation of the rotational shaft, and a reel supporting member rotatably provided at the reel supporting arm. Both sides of the web are supported by the reel supporting members of the opposing pair thereof. A residual paper web winding device of such reel feeding apparatus comprises a transmitting member provided on at least one of the reel supporting members of the opposing pair of the reel supporting arms, a driving unit for driving the transmitting member to be rotatable, and a gas blow unit for blowing gas to a residual paper web which is drawn out and hung down from the reel supported by the reel supporting members, so as to spread out the hung-down residual paper web.

5 Claims, 7 Drawing Sheets

RESIDUAL PAPER WEB WINDING DEVICE

BACKGROUND OF THE INVENTION

1. FIELD OF THE INVENTION

The present invention relates to a residual paper web winding device used in a reel feeding apparatus for continuously feeding a paper web spliced with a subsequent another paper web, and for example, to a residual paper web winding device for rewinding a residual paper web onto a reel core, the residual paper web remaining in a state of being drawn out from a first reel at a portion at an upstream side from a cut portion of the first reel when the first reel being forwardly fed and a second reel waiting to be spliced are spliced to each other and then the first reel is cut at a predetermined cutting portion in a web rotary press.

2. DESCRIPTION OF THE RELATED ART

As a conventional residual paper web winding device for a reel feeding apparatus, "residual paper web winding device" disclosed in Japanese Patent Application Laid-Open No. HEI 4-223957, "residual core recovering device" disclosed in Japanese Utility Model Application Laid-Open No. HEI 1-106465, "automatic reel loader" disclosed in Japanese Patent Application Laid-Open No. HEI 2-70645, and "belt-shaped body winding device" disclosed in Japanese Patent Application Laid-Open No. HEI 8-175725 are respectively well known.

Further, it is to be noted that the term "web" used herein may be replaced with "paper web" or merely "paper".

The residual paper web winding device disclosed in Japanese Patent Application Laid-Open No. HEI 4-223957 for a reel feeding apparatus having reel supporting bodies provided to a rotating shaft is constructed so as to comprise a transmitting member provided at each reel supporting arm of at least one of the reel supporting bodies and a rotatively driving means having a driving source engageable with or disengageable from the transmitting member, for driving the transmitting member when the driving source is engaged with the transmitting member.

At a waiting position of the rotatively driving means between the splicing position and the reel changing position, the transmitting member is engaged with the rotatively driving means by an operation of the driving source of the rotatively driving means, and the paper web is rotated in a direction reverse to the paper web feeding direction. Due to the above operations, the residual paper web, which is drawn out from the reel core at the time of being forwardly fed and is hung down at a portion extending upstream from the cut portion cut at the time of the splicing, is rewound onto the reel core.

The residual core recovering device disclosed in Japanese Utility Model Application Laid-Open No. HEI 1-106465 for recovering a residual core after the splicing discloses three embodiments. In a first embodiment, the device is constructed with a resistor bar in front of the residual core for the purpose of uniformly winding the residual paper web, and the resistor bar imparts a resistance to an entire width of the residual paper web extending to the top end thereof. Then, the residual paper web is rewound around the reel core.

In a second embodiment, resistor plates are provided at both outsides of the width direction of the residual paper web in front of the residual core in an inclined manner so as to open toward outside and the residual paper web is then rewound. Only the outside position of the paper web width of the residual paper web receives the resistance by the action of the inclined resistor plates, whereby the residual paper web is brought to a central portion and then rewound.

In a third embodiment, rollers each contacting to an periphery of the residual core are provided to both sides in the sheet width direction of the residual core. When the rollers are rotatively transferred toward the central portion of the width of the residual core while the residual paper web is wound, the irregularities formed on both peripheral sides of the residual core in width direction are uniformed by the rollers, thus resulting in bringing the wrinkles toward the central portion of the residual core.

The automatic reel loader disclosed in Japanese Patent Application Laid-Open No. HEI 2-70645, which is the residual core recovering device for recovering the residual core after the splicing is completed, is constructed so as to comprise a transporting truck for loading and transporting the reel to be loaded thereon, a residual core receiver liftably and tiltably provided on the transporting truck, a roller for imparting an ironing function onto a surface of the residual core when the residual core is rewound, and a tape winding machine for winding an adhesive tape around the periphery of the residual core.

The above device functions as follows. Namely, the roller imparts the ironing function onto the residual paper web, and then the residual paper web is rewound onto the residual core. Subsequently, the adhesive tape is wound around the periphery of the residual paper web. Thereafter, the residual core is detached from the reel supporting arm and then received onto the residual core receiver of the automatic reel loader.

The belt-shaped body winding device disclosed in Japanese Patent Application Laid-Open No. HEI 8-175725 for rewinding a belt-shaped body is constructed so as to comprise a feed-out member provided at an upper portion of the device for feeding out the belt-shaped body, a hopper member composed of guide plates for guiding the belt-shaped body, a detecting member for detecting a position of the belt-shaped body, a first air nozzle for regulating or guiding the belt-shaped body toward the guide plates by blowing compressed air and supplying a blowing pressure onto one side of the belt-shaped body, a second air nozzle for blowing compressed air to another side of the belt-shaped body, a transfer roller for transferring the belt-shaped body downward, and a winding drum for rewinding the belt-shaped body thereon.

The above device functions as follows. Namely, the belt-shaped body to be fed out from the feed-out member receives the blowing pressure caused by the air ejected from the first air nozzle, thereby to be guided along the guide plates and introduced into the hopper member. Subsequently, the belt-shaped body fed out from the transfer roller is rewound onto the winding drum. When the detecting member detects that an end portion of the rewound belt-shaped body reaches to a suitable position on the feed-out member, the second air nozzle blows compressed air. At this time, the blowing pressure blows off the belt-shaped body rewound along the guide plate toward the opposite guide plate, whereby the belt-shaped body is hung down on the guide plate. Thereafter, another belt-shaped body is fed out from the feed-out member and approaches into the hopper member. At this time, the another belt-shaped body travels along the guide plate by the action of the compressed air blown from the first air nozzle. Then, the newly fed out belt-shaped body together with the previous belt-shaped body are pinched between the transfer rollers, and fed out downwards from the hopper member in a superposed state, then rewound onto the winding drum.

Each of the aforementioned conventional arts involves several problems to be solved. Namely, in the residual paper web winding device disclosed in Japanese Patent Application Laid-Open No. HEI 4-223957, since the reel supporting bodies are moved to the waiting position of the rotatively driving means which varies from the splicing position to the reel changing position, the residual paper web, fed out from the reel core during the paper web being forwardly travelled to be consumed and hung down at a portion ranging upstream from the cut portion formed at the splicing operation, would take various shapes. In this case, a residual paper web having a plain and uniform shape. Most of the residual paper webs would have many wrinkles and overlapped or superposed portions thereby to form irregularities. Since it is quite difficult for the rotatively driving means to uniformly rewind such residual paper web, there is disadvantageously provided a residual core having a surface with wrinkles and irregularities and non-uniformity in outer diameter.

Further, as shown in FIGS. 10 and 11, in a case where the residual core is received by the residual core recovering truck 40 for timely recovering the residual core, the residual core receiver 42 is lifted by means of a lifting device 41, then an outer diameter of the residual core is detected by a sensor (not shown) and the residual core receiver 42 is stopped at a suitable position X receiving the residual core.

In this case, however, when the surface of the residual core is formed so as to have wrinkles and irregularities thereon, since an apparent diameter of the residual core becomes large, the sensor for detecting the diameter will be erroneously operated in advance. As a result, a distance or clearance between the surface of the residual core and the surface of the residual core receiver 42 is left larger than a predetermined value, whereby the residual core receiver 42 is stopped at an unsuitable position Y for receiving the residual core.

In this case, when the reel supporting shafts 4, 4 of both the right and left sides are moved outside, and the residual core is tried to be dropped and recovered onto the residual core receiver 42, if the clearance between the surface of the residual core and the surface of the residual core receiver 42 is larger than a predetermined value, the reel supporting shaft 4 of one side (left side) will get out from the residual core in advance, and the one side (left side) of the residual core is dropped in advance on the surface of the residual core receiver 42. As a result, as shown in FIG. 11, the residual core will pivot on the reel supporting shaft 4 of another side (right side), drop and then held in an inclined state with a large inclination angle.

Next, the another side (right side) of the residual core is also going to detach from the reel supporting shaft 4 on a fulcrum of the one side (left side) of the residual core which is received on a surface of the residual core receiver 42. However, the residual core is inclined with a large inclination angle and the fulcrum of one side (rotation center) going to detach is deviated toward a machine center, so that a clearance between the end surface of the another side of the residual core and the reel supporting shaft 4 moved outward will be lost. As a result, the another side of the residual core will stick to the reel supporting shaft 4 and cannot further drop down, whereby it becomes impossible to recover the residual core. In such a case, there may be posed a problem that a limit switch 43 for confirming the reception of the residual core is not operated, and subsequent control cannot be performed at all.

The residual core recovering device disclosed in Japanese Utility Model Application Laid-Open No. HEI 1-106465 will provide the following disadvantages and faults. Namely, in a case where the residual paper web is not uniformly wound and the end portions, particularly both side portions of the residual paper web in width direction, are hung down when the transporting truck for recovering the residual core receives the same, the hung-down paper webs are liable to close or cover the collision-prevention sensor provided on the transporting truck. As a result, the sensor detects as if there were some obstructions before the sensor, so that the transporting truck remains as it stopped, whereby the function of the automatic discharging system for discharging the residual core is completely lost.

To prevent such fault, the first embodiment of this application discloses a construction in which a resistor bar is used so as to uniformly rewind the residual paper web, while the second and third embodiments disclose a construction enable only peripheral portion of both sides of the residual core to be uniform so as to prevent the sensor provided on the transporting truck from being closed or covered by the residual paper web.

However, in a case of the first embodiment where the residual paper web is hung down after the splicing operation and has wrinkles superposed to each other, the residual paper web is rewound so as to leave the wrinkles as they are formed even if the resistance is imparted to the residual paper web by a function of the resistor bar. This is because the resistor bar has not a function of spreading out the wrinkles.

In contrast, from the beginning, the prior art invention shown in the second and third embodiments has no intention of uniformly rewinding an entire width of the residual paper web. When the first embodiment is used together with the second embodiment, or when the first embodiment is used together with the third embodiment, the object of the prior art invention can be achieved to some extent.

In both cases, however, there may be posed a problem of difficulty in uniformly winding the entire width of the residual paper web. As a result, a central portion of the residual paper web is liable to swell out, so that it becomes difficult to handle or orderly pile up on the residual cores when an effort is made try to pile up the residual cores after recovering them.

Further, since the residual core recovering device having a refuge mechanism is provided between the residual core supporting arm and the transporting truck for recovering the residual core so as not to obstruct other mechanisms, a large space is required for constructing the device. Furthermore, the mechanism is provided with a member directly contacting with a paper web, so that an installation position or a size of the device is disadvantageously limited so as to obtain an effective function, and the maintenance works for coping with wear, failure or the like of the constituting parts is frequently required.

The automatic reel loader disclosed in Japanese Patent Application Laid-Open No. HEI 2-70645 will pose a following problem. Namely, in a case where the residual paper web is not uniformly rewound and the end portions of the residual paper web are hung down when the transporting truck for recovering the residual core receives the residual core, the hung-down paper webs are liable to close or cover the collision-prevention sensor provided on the transporting truck. As a result, the sensor detects as if there were some obstructions before the sensor, so that the transporting truck remains as it stopped, whereby the function of the automatic discharging system for discharging the residual core is completely lost.

To prevent this failure, there also exists another apparatus in which the residual paper web winding device for uniformly rewinding the residual paper web is provided for the automatic reel loader that is a reel attaching device and residual core recovering device. In this case, however, since the ironing roller provided on the residual core receiver of the automatic reel loader has no function of spreading out the wrinkles, the wrinkles are unavoidably formed and superposed to each other on the residual paper web. Therefore, the surface of the residual paper web cannot be uniformly rewound even if the ironing function is imparted to the residual paper web by press-contacting the ironing roller onto the surface of the residual core.

In the above prior art apparatus, the adhesive tape is wound around the outer periphery of the residual core so as not to loosen the residual core having wrinkles and irregularities. Further, when the automatic reel loader is transferred toward the residual paper web receiving position, the reel loader is liable to collide with the residual paper web drawn out from the reel core in a long length, or the wheel of the reel loader is liable to run on the residual paper web. In any case, there may be a case where the residual paper web cannot be smoothly rewound. Furthermore, since the automatic reel loader is required to be provided with the residual core winding device, there is also a problem that the automatic reel loader will be complicated and has a large size, thus resulting in increasing of the manufacturing cost thereof.

In addition, the mechanism is provided with a member directly contacting with a paper web, so that an installation position or a size of the device is disadvantageously limited in order to obtain an effective function, and the maintenance works for coping with wear, failure or the like of the constituting parts is frequently required.

The belt-shaped body winding device disclosed in Japanese Patent Application Laid-Open No. HEI 8-175725 shows a winding device for rewinding the belt-shaped body by utilizing the compressed air and the guide plates. The compressed air has only two functions, i.e., the function of blowing off the end portion of the belt-shaped body toward one guide plate, and the function of guiding the end portion of a subsequent belt-shaped body along the another guide plate. The compressed air has no function of uniformly or smoothly rewinding the belt-shaped body, while such function is performed by the guide plates. Therefore, even if the belt-shaped body is tried to be rewound, the belt-shaped body cannot be uniformly rewound at all. In addition, the controlling operations for detecting the end portion of the belt-shaped body and for detecting the presence or absence of the belt-shaped body or the like are required, thus providing a troublesome problem.

SUMMARY OF THE INVENTION

The present invention had achieved a solution for all the aforementioned problems involved in the prior arts, and the object of this invention is to provide a residual paper web winding device capable of rewinding a residual paper web so as to provide a uniform surface on the residual core, and having a simple construction, an easiness in controlling and less frequency of failure resulting in easy maintenance work for the device.

This and other objects can be achieved according to the present invention by providing a residual paper web winding device used in a reel feeding apparatus which comprises a rotational shaft to be rotatively driven, plural pairs of reel supporting arms radially provided at positions in an equally divided arrangement around the rotational shaft, each of the pairs of the reel supporting arms being arranged opposite to each other in an axial direction of the rotational shaft and movable in accordance with the rotation of the rotational shaft, and a reel supporting member rotatably provided at the reel supporting arm, and in which both sides of the reel are supported by the reel supporting members of the opposing pair of reel supporting arms, the residual paper web winding device comprising:

- a transmitting member provided on at least one of the reel supporting members of the opposing pair of reel supporting arms;
- a driving unit for driving the transmitting member to be rotatable; and
- a gas blow unit for blowing gas to a residual paper web which is drawn out and hung down from the reel supported by the reel supporting members thereby to spread out the hung-down residual paper web.

In a preferred embodiment, the residual sheet winding device can also be constructed so that a gas blowing hole is provided at every position corresponding to the width of each paper web so as to cope with various paper webs each having a different width.

Furthermore, the following various modifications or variations can be made in the residual paper web winding device described above. Namely, the gas blowing hole may be movably provided along the web width direction so as to cope with various paper webs each having a different width, whereby the gas blowing hole can be moved and stopped at each position corresponding to the width of the each paper web.

In addition, the gas blow unit can be constructed so as to comprise a plurality of gas blowing holes wherein one gas blowing hole blows an air having a strong blowing force while the other gas blowing hole blows an air having a weak blowing force.

Further, the gas blow unit can also be constructed so as to blow the air having a strong force to the end portion of the residual paper web while blowing the air having a weak blowing force to a portion close to the winding core for rewinding the residual paper web.

Thus constructed residual paper web winding device attains the following functions and advantageous effects. That is, when the diameter of the reel supported by the reel supporting member provided on the reel supporting arm reaches a predetermined value, the paper web drawn out from the reel is cut, and the cut paper web is then spliced with a subsequent paper web of another reel. Thereafter, the spliced paper web is continuously drawn out. At this time, the residual paper web of the cut-side is hung down. Under this state, when the transmitting member provided on the reel supporting member is rotated by the rotatively driving means, the residual paper web is rewound around the residual core. At this time, when the gas is blown from the gas blowing means, the hung-down residual paper web is spread out by the blowing gas thereby to eliminate wrinkles and superposition or overlaps formed on the paper web. Then the residual paper web is smoothly rewound.

The nature, utility, and further features of this invention will be more clearly apparent from the following detailed description with respect to preferred embodiments of the invention when read in conjunction with the accompanying drawings briefly described below.

DESCRIPTION OF THE PREFERRED EMBODIMENT

Reference will now be made in detail to the preferred embodiments of the present invention, an example of which is illustrated in the accompanying drawings.

Figure 1:
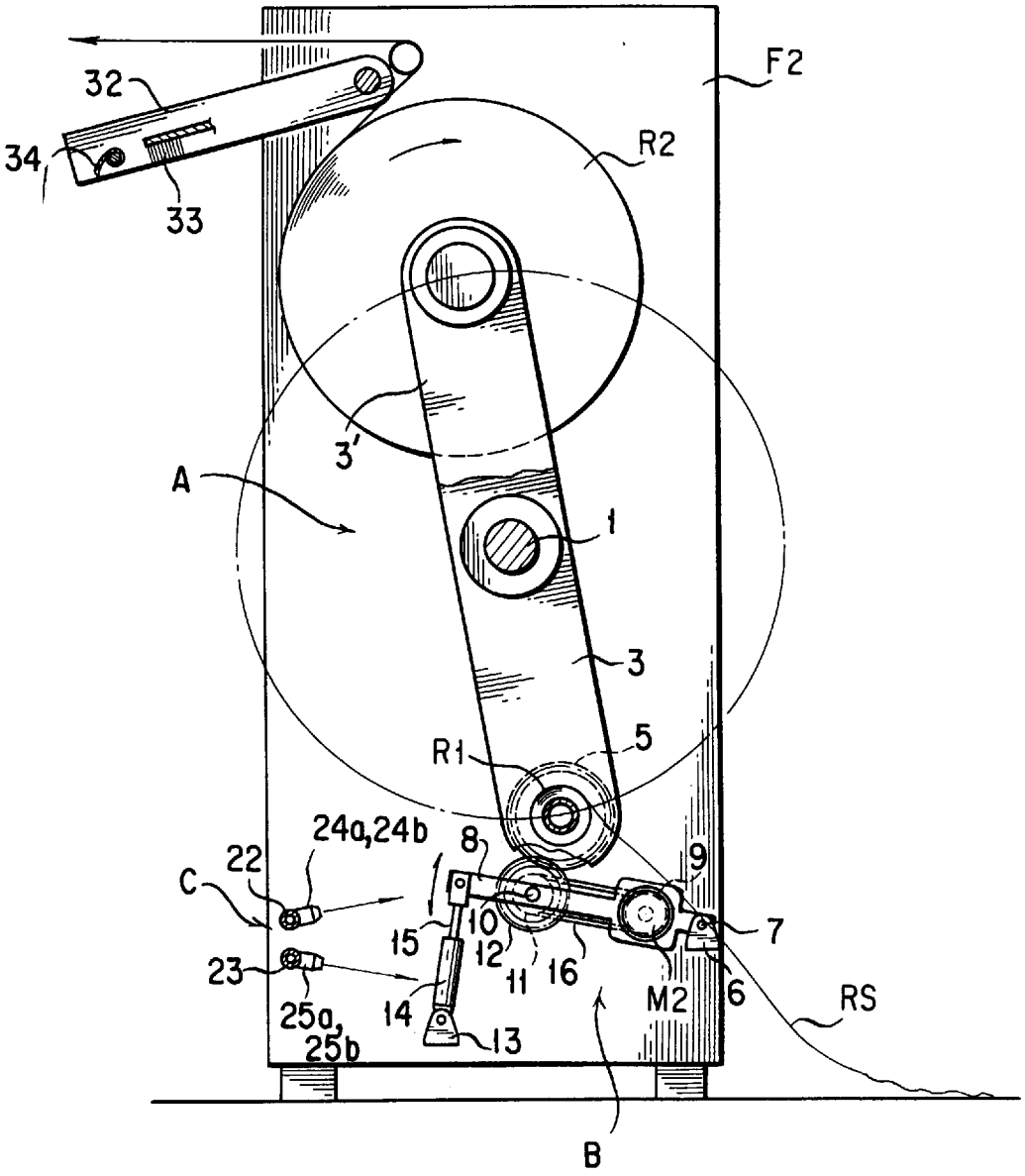
FIG. 1 is a side view partially sectioned showing a reel feeding apparatus comprising a residual paper web winding device according to the present invention.
Figure 2:
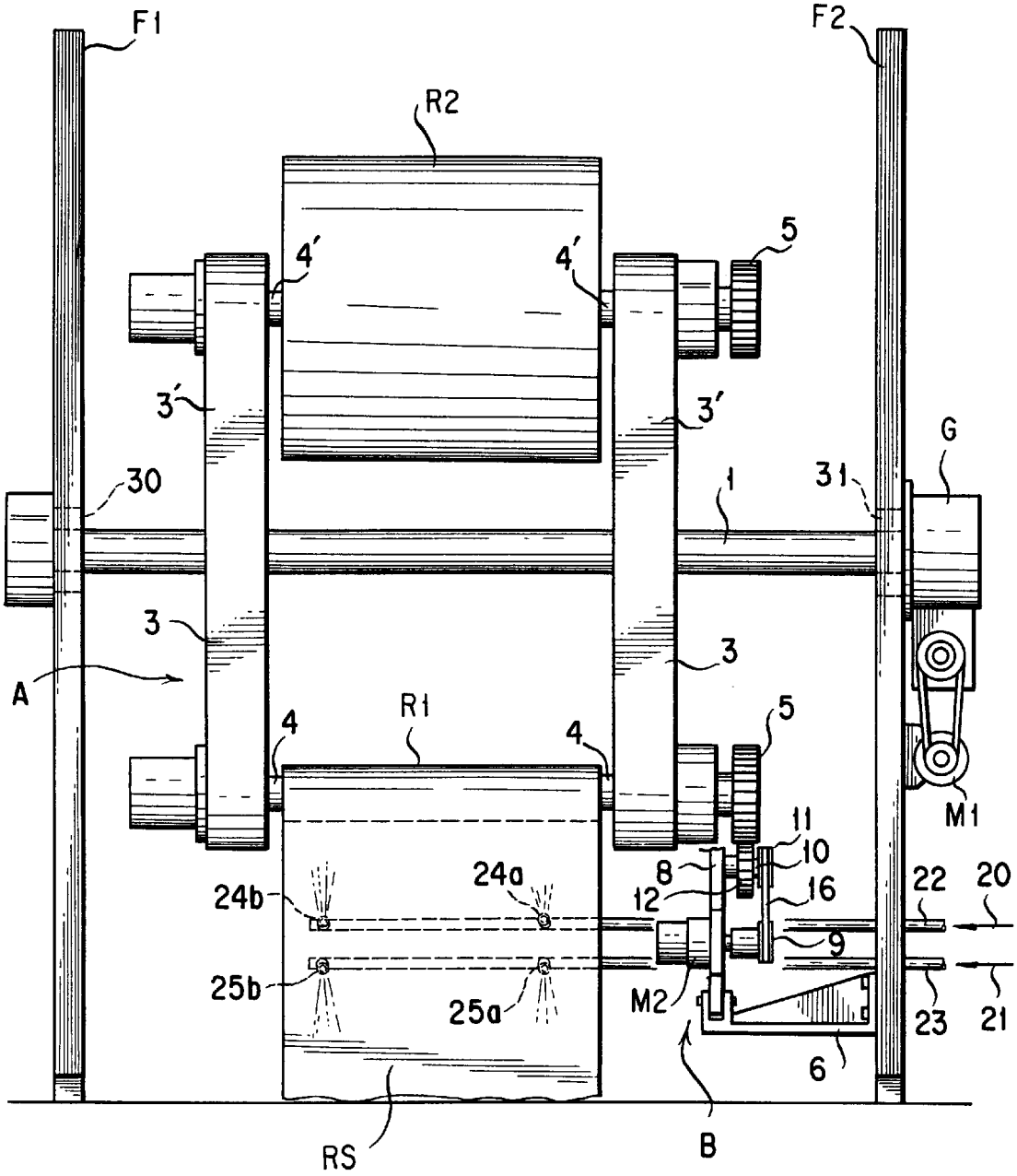
FIG. 2 is a front view showing a reel feeding apparatus comprising a residual paper web winding device according to the present invention.
Figure 3:
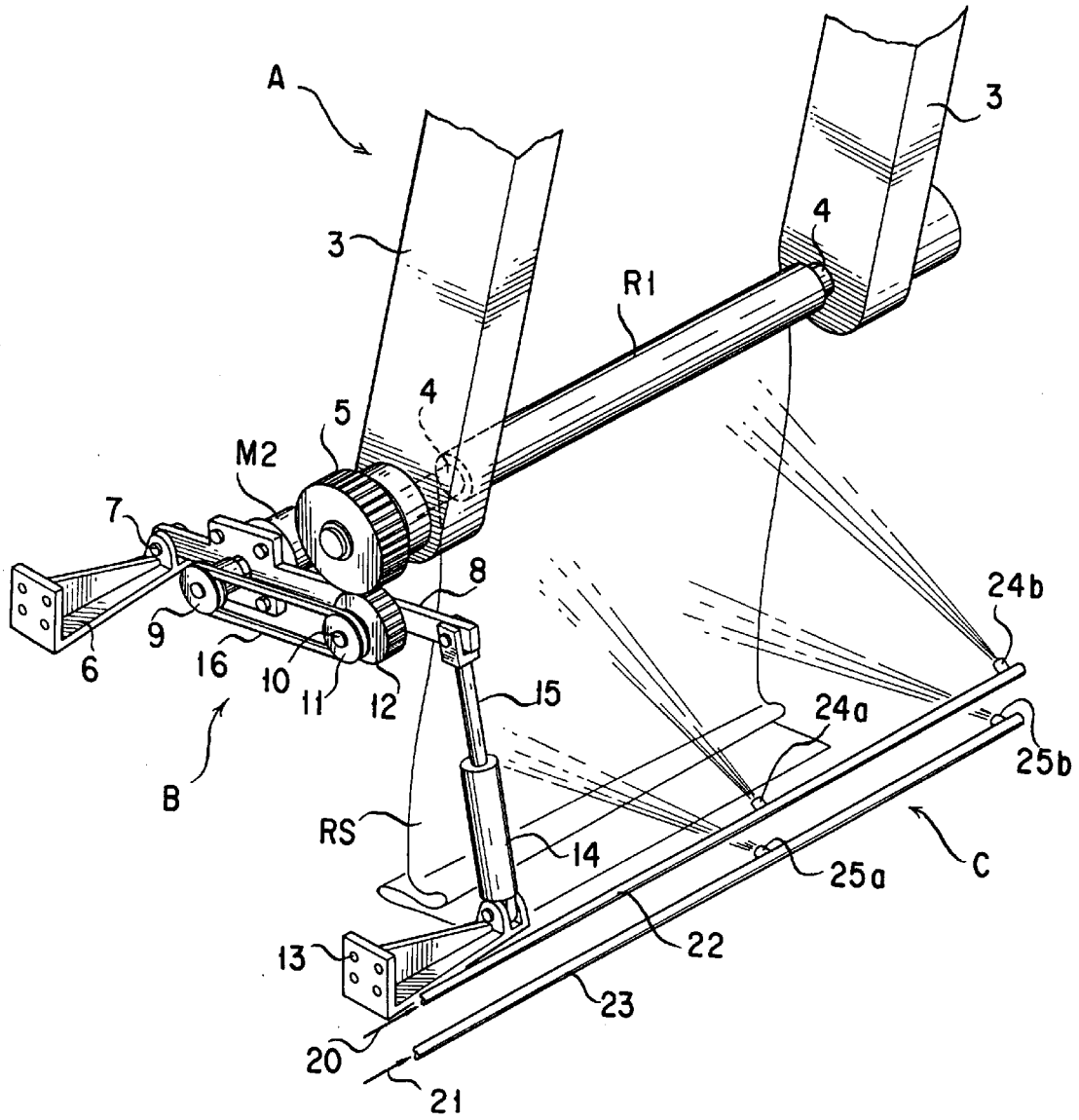
FIG. 3 is a perspective view showing an essential part of the present invention.
Figure 4:
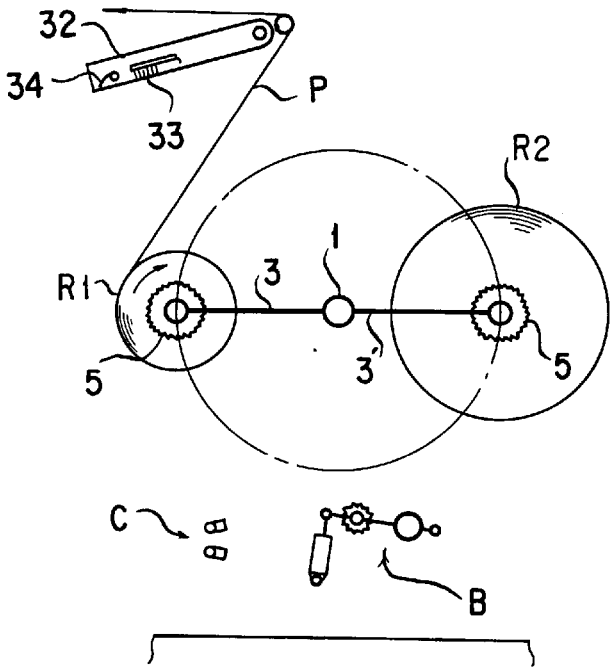
FIG. 4 is an explanatory view showing an operation of the present invention.
Figure 5:
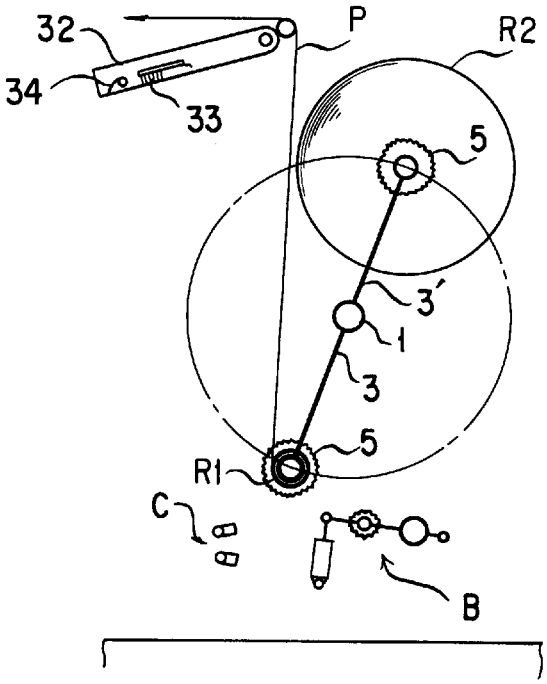
FIG. 5 is another explanatory view showing an operation of the present invention.
Figure 8:
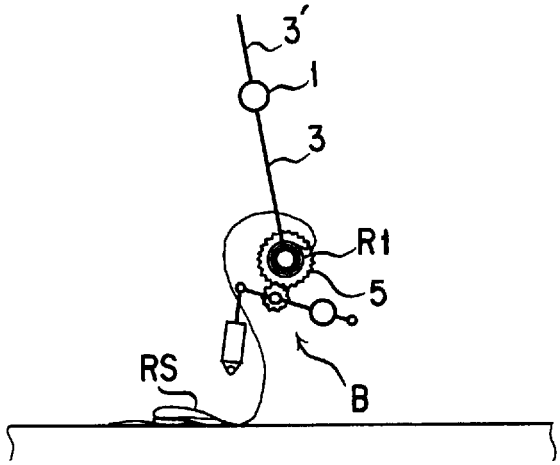
FIG. 8 is a view showing a state when the residual paper web is dropped off.
Figure 9:
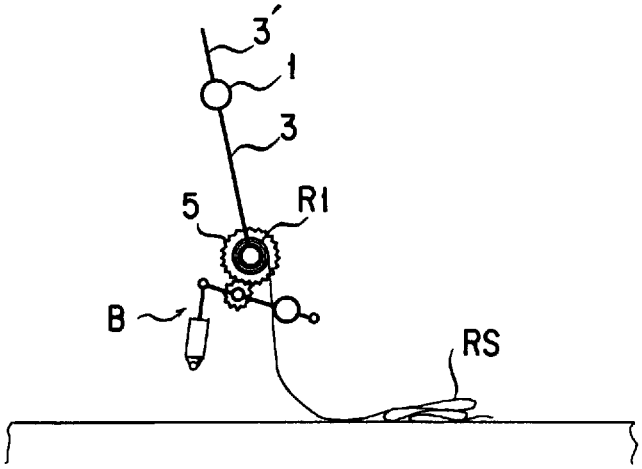
FIG. 9 is another view showing a state when the residual paper web is dropped off.
Figure 10:
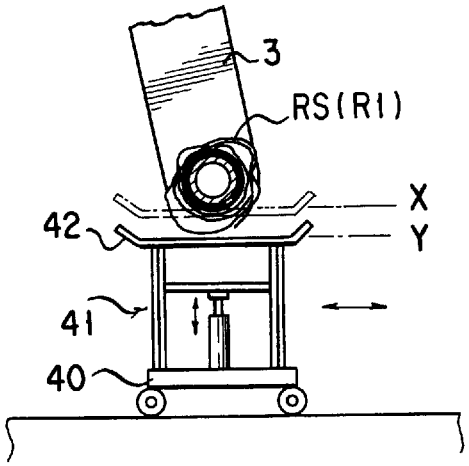
FIG. 10 PRIOR ART
FIG. 10 is a side view showing an outline of the state when the residual core is received in a conventional example.
Figure 11:
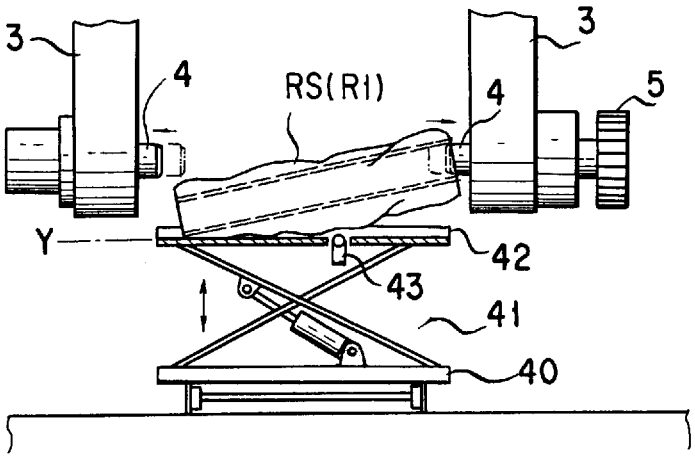
FIG. 11 PRIOR ART
FIG. 11 is a front view showing an outline of the state when the residual core is received in a conventional example.

FIGS. 1 and 2 show a reel feeding apparatus comprising a residual paper web winding device according to the present invention. FIG. 3 is a perspective view showing in detail a transmitting member of a rotatively driving means. FIGS. 4, 5, 6 and 7 are explanatory views respectively showing an operation of the present invention. In addition, FIGS. 8 and 9 are schematic diagrams respectively showing a feature when the residual paper web is dropped off, and FIGS. 10 and 11 are schematic diagrams respectively showing a conventional state when the residual core is received.

As shown in FIGS. 1 and 2, the reel feeding apparatus is constructed so as to comprise a reel supporting structure A for supporting a plurality of a first reel R1 and a second reel R2. The reel supporting structure A comprises a rotational shaft 1, a plurality of pairs of reel supporting arms 3, 3, 3' and 3', and reel supporting shafts 4, 4, 4' and 4' as the reel supporting members. The rotational shaft 1 is rotatably supported by sleeves 30 and 31 each fixed to the opposing frames F1 and F2, and the rotational shaft 1 is rotatively driven by a first motor M1 through a gear box G. The first motor M1 is fixed to the frame F2. The plural pairs of reel supporting arms 3, 3, 3' and 3' are slidably and controllably provided on the rotational shaft 1 so as to oppose to each other in the axial direction of the rotational shaft 1. In the embodiment shown in FIGS. 1 and 2, two pairs of reel supporting arms 3, 3, 3' and 3' with a central angle of 180 degrees are provided so as to oppose to each other.

At the top portions of each of the reel supporting arms 3, 3', reel supporting shafts 4, 4' are rotatably provided, and also the reel supporting shafts 4, 4' are constructed so as to protrude or sink with respect to the reel supporting arms 3, 3'. The reel supporting shafts 4, 4' provided on the reel supporting arms 3, 3' and the reel supporting shafts 4, 4' provided on the reel supporting arms 3, 3' are opposed to each other on the same line parallel to the rotational shaft 1. The first reel R1 and the second reel R2 are loaded onto the each pair of opposing reel supporting shaft 4, 4, 4', 4'.

On the respective reel supporting shafts 4, 4' provided on at least one of the opposing reel supporting arms 3, 3' in a pair, there is provided a gear 5 as a transmitting member for transmitting the rotation to the respective reel supporting shafts 4, 4'. In addition, there is provided a suitable rotatively driving means B, i.e. driving means for driving a transmitting member to be rotatable, capable of interrupting the transmission by engaging with or disengaging from the gear 5. In the embodiment shown in FIGS. 1 and 2, the rotatively driving means B is provided at a lower portion of a side of the frame F2.

The rotatively driving means B is constructed as shown in FIGS. 1 to 3. That is, at a first bracket 6 fixed to the frame F2, there is provided an arm 8 capable of angularly displacing around a shaft 7 as a fulcrum. A first toothed pulley or a sprocket 9 is provided at a rotational shaft of a second motor M2 fixed close to a shaft of the arm 8, while a second toothed pulley or a sprocket 11 and a gear 12 are provided at a supporting shaft 10 rotatably supported at a center portion of the arm 8.

A top end of the arm 8 angularly displacing around the shaft 7 as a fulcrum is operatively connected to a top end of a cylinder rod 15 of a hydraulic cylinder 14 which is angular-displaceably provided on a second bracket 13 fixed to the frame F2, and the gear 5 is capable of engaging with or disengaging from the gear 12 in accordance with the angular displacement of the arm 8. Then, the first toothed pulley or the sprocket 9 and the second toothed pulley or the sprocket 11 are operatively connected through an endless toothed belt or an endless chain 16.

As the rotatively driving means B, any type of a rotatively driving means is adaptable as far as it can transmit the driving force of the second motor M2 to the gear 5 as a transmitting member. For example, in the embodiment shown in FIGS. 1 to 3, the gear 5 having a wide tooth width is provided so that the gear 5 shall engage with the gear 12, which is provided for the rotatively driving means B fixed to the frame F2, within a displacing range of the reel supporting arm 3 when the displacement of the reel supporting arm 3 is controlled in an axial direction of the rotational shaft 1.

However, in a case where the displacement range is greatly wider than that of the case described above, for example, there can also be adapted a mechanism (not shown) so that the rotatively driving means B itself follows up the displacement. Stated more concretely, the rotatively driving means B is provided at a portion close to the rotational shaft 1, and is formed so that the rotatively driving means B shall follow up the displacement of the reel supporting arm 3 when the displacement is controlled in the axial direction of the rotational shaft 1.

Figure 6:
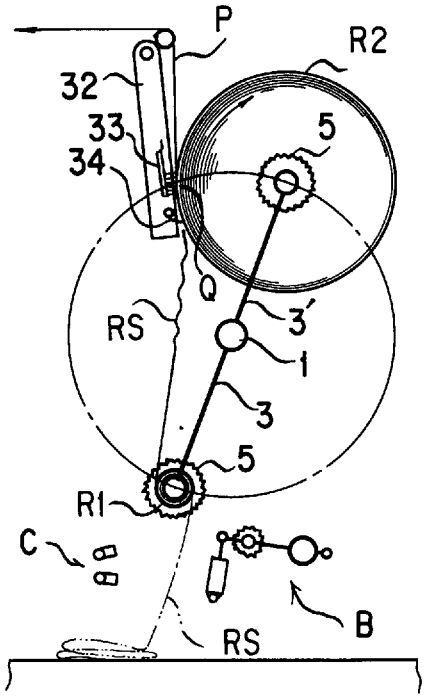
FIG. 6 is a further explanatory view showing an operation of the present invention.
Figure 7:
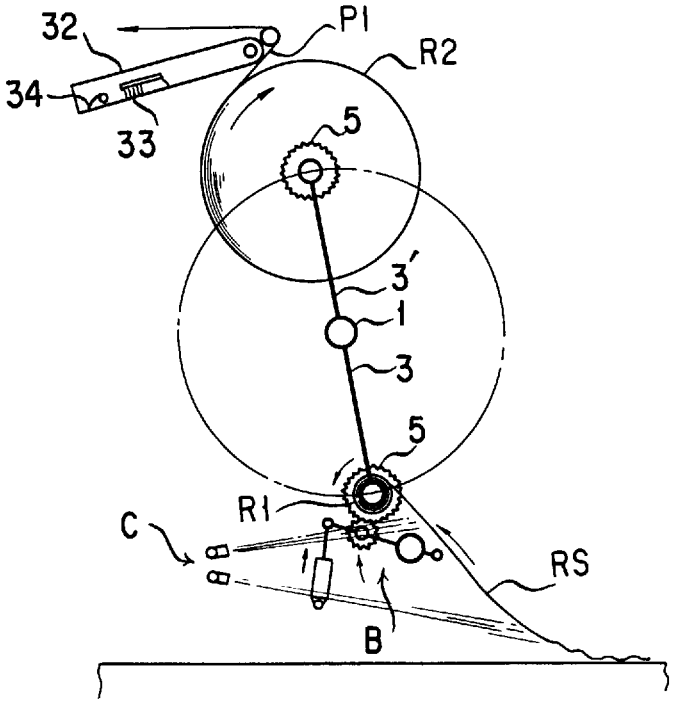
FIG. 7 is a still further explanatory view showing an operation of the present invention.

Further, in the shown embodiment, it is preferable to provide the rotatively driving means B so as to be capable of transmitting the rotation to the reel supporting shaft 4 at a waiting position where the reel supporting arm 3 is in a state shown in FIG. 7. However, it is also preferable to provide the rotatively driving means B so as to transmit the rotation at a splicing position where the reel supporting arm is in a state shown in FIG. 6.

As the other features as shown in FIGS. 1, 2 and 3, a gas blowing means C is provided at a lower portion of the reel feeding. apparatus. The gases 20 and 21 i.e., compressed gases (hereinafter referred to as compressed air 20 or compressed air 21) are supplied through pipes 22 and 23 from a gas supplying source (not shown) installed outside the apparatus. The pipes 22 and 23 are provided between the frames F1 and F2 so as to extend in a direction parallel to the rotational shaft 1.

At the respective pipe 22 and 23, there are provided a plurality of gas blowing holes 24*a*, 24*b*, 25*a*, 25*b* each directing toward a lower portion of the reel feeding apparatus, and the gas blowing holes are provided at plurality of portions (two portions for the respective pipe in this embodiment) within a range of the reel width. Further, a solenoid valve (not shown) is connected to an appropriate portion of the respective pipe 22 and 23 so as to perform ON-OFF control of the compressed air supply.

Furthermore, in the gas blowing holes 24*a* and 24*b* for blowing the compressed air 20 and the gas blowing holes 25*a* and 25*b* for blowing the compressed air 21, a control valve (not shown) may be provided at an upstream-side of the respective gas blowing hole so that the gas blowing holes 24*a* and 24*b* or 25*a* and 25*b* of both right and left sides shall provide the same blowing pressure.

In addition, a paster arm 32 to be operated at, the splicing operation is provided between the frames F1 and F2. The paster arm 32 comprises a brush 33 for attaching under pressure the travelling paper web P onto a peripheral surface of a new reel and a cutter for cutting the paper reel P at an upstream position from the position to be spliced and connected. At a surface of a paper web end Q of the second reel R2, an adhesive portion (not shown) to adhere to the paper web P is previously formed, and the paper web end Q is temporarily fixed to a peripheral surface of the second web R2.

Next, an operation of thus constructed embodiment will be explained hereunder. A normal printing operation is performed at the position shown in FIG. 4. When a sensor (not shown) detects that a diameter of the first reel R1, from which the paper web P is drawn out, supported by the reel supporting arm 3 reaches a predetermined first diameter, the rotational shaft 1 is rotated in a counter-clockwise direction by the starting of the first motor M1. At this time, the reel supporting arms 3 and 3' are rotatively displaced, and also both the first and second reels R1 and R2 are respectively displaced. When a sensor (not shown) detects that the first reel R1 is transferred to a position i.e, a splicing position, the first motor M1 stops, whereby the rotating displacement of the reel supporting arms 3 and 3' are also stopped.

At this splicing position described above, when a sensor (not shown) detects that a diameter of the first reel R1, from which the paper web P is drawn out, supported by the reel supporting arm 3 becomes to a predetermined second diameter, the second reel R2 is rotated in a clockwise direction by a driving device (not shown), then the second reel R2 is accelerated so that a peripheral speed of the second reel R2 reaches to a travelling speed of the paper web P taken out from the first reel R1 and travelling. Further, the paster arm 32 is displaced from a position shown in FIG. 5 to a position shown in FIG. 6.

Subsequently, as shown in FIG. 6, when a sensor (not shown) detects that a diameter of the first reel R1 reaches to a predetermined third diameter, the brush 33 is operated at a suitable timing and attaches, under pressure, the paper web P onto the peripheral surface of the second reel R2. Due to this operation, the paper web end Q of the second reel R2 adheres to the paper web P, and the temporarily fixed portion is removed and drawn out with the paper web. At almost the same time, the cutter 34 is applied to a portion upstream from the spliced and connected portion of the paper web P and the paper web P is then cut. As a result, the paper web P of the spliced second reel R2 is drawn out and travels.

On the other hand, the rotation of the first reel R1 is stopped by the action of a braking means (not shown) provided at the reel supporting shaft 4. As a result, the residual paper web RS, which is taken out from the first reel R1 and is ranging upstream from the cut portion, is hung down. After the completion of the splicing operation, the paster arm 32 is returned to a waiting status. Thereafter, the rotational shaft 1 is rotated in a counter-clockwise direction in FIG. 6 by the starting of the first motor M1 (FIG. 2), and the reel supporting arms 3 and 3' are rotatively displaced whereby both the first and second reels R1 and R2 loaded on the reel supporting arms 3 and 3' are also displaced.

When the first reel R1 is moved to a position shown in FIG. 7 due to the rotating displacement, i.e., when the gear 5 provided at the reel supporting shaft 4 is moved to a predetermined portion with which the gear 12 of the rotatively driving means B in a waiting status shall engage, a sensor detects the movement and the first motor M1 is stopped, whereby the rotating displacement of the reel supporting arms 3 and 3' is also stopped.

At the waiting position of the rotatively driving means described above, the residual paper web winding operation and residual core recovering operation are performed as described later on. The paper web P is cut by the cutter 34 at the splicing position thereby to form a residual paper web RS hung down. At the waiting position of the rotatively driving means at which the rotating displacement of the reel supporting arms 3 and 3' is stopped, the resulting residual paper web RS is usually formed so as to have a shape in a superposed status with many wrinkles. Even if the residual paper web RS in such a status is rewound, it is quite difficult to rewind the residual paper web RS so as to obtain a uniform surface.

To solve this problem, as described above, the compressed air ejected through the blowing holes 24*a*, 24*b*, 25*a*, 25*b* of the gas blowing means C is blown toward the hung-down residual paper web RS. In this case, the compressed air having a high pressure and strong blowing force is blown, through the lower side gas blowing holes 25*a* and 25*b*, toward a top portion, i.e. the cut portion of the residual paper web RS. Meanwhile, the suitable compressed air having a low pressure and a weak blowing force is blown, through the upper side gas blowing holes 24*a* and 24*b*, to a portion close to the reel core for rewinding the residual paper web RS. Such compressed air having a low pressure and a weak blowing force is effective in outwardly spreading out the wrinkles of the residual paper web RS.

The timing of the blowing the compressed air to the residual paper web RS is as follows. Namely, the blowing of the compressed air having a strong force ejected through the lower blowing holes 25*a* and 25*b* shall be started when an appropriate time is passed after the completion of the splicing operation regardless of whether the displacement of the reel supporting arms 3 and 3' is started or not. On the other hand, the blowing the compressed air shall be stopped when the reel supporting arms 3 and 3' are rotatively displaced and stopped at a next stopping position, i.e. the waiting position of the rotatively driving means. By the blowing of the compressed air having a strong blowing force, the wrinkles and superposition of the residual paper web RS are effectively spread out in the air blowing direction.

On the other hand, the blowing of the compressed air having a weak blowing force ejected through the upper gas blowing holes 24*a* and 24*b* shall be started at the same time T when the blowing the compressed air having a strong blowing force is started or shall be started at a delayed time after that time T. This blowing operation shall be continued up to a time when the reel supporting arms 3 and 3' are rotatively displaced and stopped at the next waiting position of the rotatively driving means B, subsequently, the rotatively driving means B is actuated as described later and the operation of rewinding the residual paper web RS is completed.

When the compressed air having a weak blowing force is blown to the portion close to the reel core from which the residual paper web RS is drawn out and the residual paper web RS is rewound while the wrinkles are spread out, under pressure, by application of the air blowing, it becomes possible to rewind the residual paper web with a surface having less wrinkles.

When the gas blowing holes 24*a*, 24*b*, 25*a*, 25*b* of both sides are formed so that the compressed air is blown toward the outside so as to spread out the residual paper web RS outside, the effect of spreading the wrinkles can be further improved.

In this embodiment, although the blowing hole for blowing the compressed air having a weak blowing force is provided at an upper side, and the blowing hole for blowing the compressed air having a strong blowing force is provided at a lower side, the present invention is not limited to this arrangement. That is, for example, the blowing holes may also be formed upside-down as far as the compressed air having a weak blowing force can be blown to the portion close to the reel core for rewinding the residual paper web RS while the compressed air having a strong blowing force is blown to the end portion of the residual paper web RS.

In another way, the blowing hole may be provided at every positions corresponding to the width of each reel so as to fully cope with the widths of various reels, or the blowing hole may also be movably provided so as to move or change the position of the blowing hole.

Next, the operation of the rotatively driving means B at the waiting position of the rotatively driving means will be explained hereunder. As described above, after the splicing operation is completed, when the reel supporting arms 3 and 3' are stopped at the next position i.e. the waiting position of the rotatively driving means, the hydraulic cylinder 14 is actuated, and the arm 8 is angularly displaced around the shaft 7 (clockwise direction in case of FIGS. 1 and 7, while counter-clockwise direction in case of FIG. 3), and the gear 12 is engaged with the gear 5.

Then, the second motor M2 is started and the driving force thereof is transmitted through both the first and second toothed pulleys or the sprockets 9 and 11, the endless toothed belt or the endless chain 16 and the gears 12 and 5 to the reel supporting shaft 4 for the first reel R1, whereby the reel supporting shaft 4 is rotated with an appropriate speed in a backward direction with respect to the direction to which the paper web is forwardly fed. Namely, the rotating direction in case of FIGS. 1 and 7 is a counter-clockwise direction and that in case of FIG. 3 is a clockwise direction.

Thus, the residual paper web RS which is drawn out from the reel at the time of being forwardly fed and is hung down at a portion extending upstream from the cut portion at the time of the splicing is supplied with the blowing gas from the gas blowing means C, whereby the wrinkles and superposition formed on the residual paper web are spread out, then the residual paper web is uniformly rewound around the reel core.

A sufficient time enough to complete the operation of rewinding the residual paper web RS is set by a timer. When the set time passes, the second motor M2 is stopped. Then, the hydraulic cylinder is actuated in the reverse direction and the arm 8 is angularly displaced around the shaft 7 (the displacing direction in a case of FIGS. 1 and 7 is a counter-clockwise direction and that in a case of FIG. 3 is a clockwise direction), whereby the gears 12 and 5 are disengaged with each other.

In this status, the operation for recovering the residual core is performed. As shown in FIGS. 10 and 11, this recovering operation is performed in the same manner as usual. Namely, the recovering truck 40 for recovering the residual core is provided at lower side of the residual core which is in a waiting state of the rotary driving means. Thereafter, the reel supporting shafts 4 and 4' supported by a pair of the reel supporting arms 3 and 3 are transferred outside, and the reel supporting shafts 4 and 4' are pulled out from the end portions of the residual core, thereby to perform the recovering operation.

At this time, the residual core is formed in a shape of a cylinder having a smooth surface because the residual paper web RS is uniformly rewound by the operation described above. Therefore, a sensor (not shown) for detecting an outer diameter of the residual core will detect a real outer diameter of the residual core. The residual core receiver 42 of which a lifting stroke is to be determined on the basis of the value detected by the sensor is lifted by the lifting device 41 up to the position X shown in FIG. 10. Namely, the core receiver 42 is lifted up and stopped at the position X so as to form a small clearance between the residual core and the core receiver 42.

Accordingly, at the time that the residual core has fallen down by pulling out the reel supporting shafts 4 and 4' from both ends of the residual core, even if one side of the reel supporting shaft is pulled out in advance and the one side of the residual core has previously fallen down, the clearance formed between the residual core and the residual core receiver 42 is small enough, so that an inclination angle of the fallen residual core is also small.

Therefore, even when the other side of the reel supporting shaft 4 is subsequently pulled out from the other side of the residual core, a clearance remains between the other end side of the residual core and the reel supporting shaft 4 moved outside. As a result, the other side of the reel supporting shaft 4 is also easily pulled out from the residual core without suffering any resistance, whereby the residual core can be smoothly fallen down and then recovered. The falling down of the residual core on the residual core receiver 42 is detected and confirmed by the limit switch 43. After the confirmation, a subsequent operation is started. The recovering truck 40 for recovering the residual core is transferred and the reel supporting arms 3 and 3' are rotatively displaced thereby to load a new reel at a suitable position. These serial operations are sequentially performed.

In this embodiment, although the gears 5 and 12 are used as a transmitting member for transmitting the rotation to the reel supporting shaft 4, a frictional wheel may be also used in place of the gears 5 and 12. Further, in a type of a device wherein the engagement of the gears 5 and 12 is performed at the splicing position, after the splicing operation is completed, the residual paper web is rewound at the splicing position while the compressed air having the same function as that in the embodiment described above is blown onto the residual paper web. The operating commands based on the detections of the respective sensor described above are controlled by a control unit (not shown) based on the conventionally well known art.

As described above, when the residual paper web winding device according to the present invention is put into practice, it becomes possible to rewind the residual paper web so that the residual core can have an uniform surface by the functions of the gas blowing means and the driving means for winding the residual paper web, and the faults caused by a malfunction in detecting the residual core at the time of recovering the residual core can be effectively eliminated.

In addition, when the compressed airs of different blowing forces ejected through the gas blowing means are blown to appropriate portions of the residual paper web, the effect of uniformly rewinding the residual paper web can be further improved.

Furthermore, only the pipes for supplying the compressed air and the gas blowing holes are required for the residual paper web winding device other than the driving means, so that a large space is not required for the device, and the construction and controlling of the device can be simplified. Accordingly, there can be provided a residual paper web winding device having less frequency of causing a fault, an easiness in maintenance, and having a space-saving characteristic.

It is to be noted that the present invention is not limited to the described embodiment and many other changes and modifications may be made without departing from the scope of the appended claims.

What is claimed is:

1. A residual paper web winding device used in a reel feeding apparatus which comprises a rotational shaft to be rotatably driven, plural pairs of reel supporting arms radially provided in an equally divided arrangement around the rotational shaft, each of the pairs of the said supporting arms being arranged opposite to each other in an axial direction of the rotational shaft and movable in accordance with the rotation of the rotational shaft, and a reel supporting member rotatably provided at the reel supporting arm, and in which both sides of the reel are supported by the reel supporting members of the opposing pair thereof, said residual paper web winding device comprising:

a transmitting member provided on at least one of said reel supporting members of the opposing pair of the reel supporting arms;

a driving means for driving the transmitting member to be rotatable; and a gas blow means for blowing gas to a residual paper web which is drawn out and hung down from the reel supported by the reel supporting members, so as to spread out the hung-down residual paper web.

2. A residual paper web winding device according to claim 1, wherein said gas blow means is provided with a gas blowing hole formed at every position corresponding to a width of each residual paper web so as to cope with various residual paper webs each having a different width.

3. A residual paper web winding device according to claim 1, wherein said gas blow means is provided with a gas blowing hole movably provided along a width direction of the paper web so as to cope with various paper webs each having a different width and to be moved and stopped at each position corresponding to the width of said each paper web.

4. A residual paper web winding device according to any one of claims 1, 2 or 3, wherein said gas blow means is provided with a plurality of gas blowing holes so that one of the gas blowing hole blows a gas having a strong blowing force while another one of the gas blowing hole blows a gas having a weak blowing force.

5. A residual paper web winding device according to claim 4, wherein said gas blow means is formed so as to blow a gas having a strong blowing force to an end portion of said residual paper web, while blowing a gas having a weak blowing force to a portion close to a reel core for rewinding the residual paper web.

* * * * *